United States Patent [19]

Ishii

[11] 4,310,834

[45] Jan. 12, 1982

[54] MOTOR ACTUATED BELL

[75] Inventor: Tadashi Ishii, Tokyo, Japan

[73] Assignee: Kobishi Electric Co., Ltd., Tokyo, Japan

[21] Appl. No.: 152,757

[22] Filed: May 23, 1980

[51] Int. Cl.[3] ..... G08B 3/10

[52] U.S. Cl. ..... 340/392; 340/399; 340/402

[58] Field of Search ..... 340/392, 399, 402

[56] References Cited

U.S. PATENT DOCUMENTS 2,046,698 7/1936 Power ..... 340/399

2,046,705 7/1936 Stoller ..... 340/399

FOREIGN PATENT DOCUMENTS 516860 1/1953 Belgium ..... 340/402

*Primary Examiner*—Harold I. Pitts

*Attorney, Agent, or Firm*—Darby & Darby

[57] ABSTRACT

A motor actuated bell comprises a motor having a drive shaft and a cam means connected to the drive shaft. The cam means is engageable with an elongated hammer intermediate the opposite ends thereof to intermittently move the hammer away from a gong against the bias of an urging means. When the cam means becomes disengaged from the hammer, the hammer is moved along its axis into striking contact with the gong under the action of the urging means.

4 Claims, 3 Drawing Figures

MOTOR ACTUATED BELL

BACKGROUND OF THE INVENTION

1. Field of the Invention

This invention relates generally to motor actuated bells and more particularly to a motor actuated bell of the type in which a motor drives a hammer through a transmission means to strike against an associated gong with substantial impact to thereby produce bell sound of great volume.

2. Prior Art

One conventional motor actuated bell, as shown in FIG. 3, comprises a small DC motor 100 having a drive shaft 101 on which a gear 102 is fixedly mounted, a wheel gear 103 fixedly mounted on a shaft 104 and engaging the gear 102, and a cam 105 mounted on the shaft 104. With this construction, the motor 100 is driven to rotate the cam 105 through the meshed gears 102, 103 so that the cam intermittently acts on the end of a hammer 106 to allow the same to strike against an associated gong against the bias of a coil spring 107 to produce bell sound. This known motor driven bell has been found not entirely satisfactory in that the motor need to provide a substantial torque to enable the hammer to strike against the gong with substantial impact to produce bell sound of great volume.

SUMMARY OF THE INVENTION

It is therefore an object of this invention to provide a motor actuated bell of the type which is capable of producing bell sound of substantial volume without the need for a great motor torque.

According to the present invention, there is provided a motor actuated bell which comprises a base; a gong mounted on the base; a motor mounted on the base and having a rotatable drive shaft; an elongated hammer supported on the base for movement along its axis to strike against the gong at its one end, an urging means normally urging the hammer toward the gong; and a cam means connected to the motor drive shaft, the cam means being engageable with the hammer intermediate the opposite ends thereof for moving the hammer away from the gong against the bias of the urging means whereby when the cam means becomes disengaged from the hammer, the hammer is brought into striking contact with the gong at the one end thereof under the action of the urging means.

Other advantages, features and additional objects of the present invention will become manifest to those versed in the art upon making reference to the detailed description and the accompanying sheets of drawings in which a preferred embodiment incorporating the principles of the present invention is shown by way of illustrative example.

DESCRIPTION OF THE PREFERRED EMBODIMENT OF THE INVENTION

Figure 1:
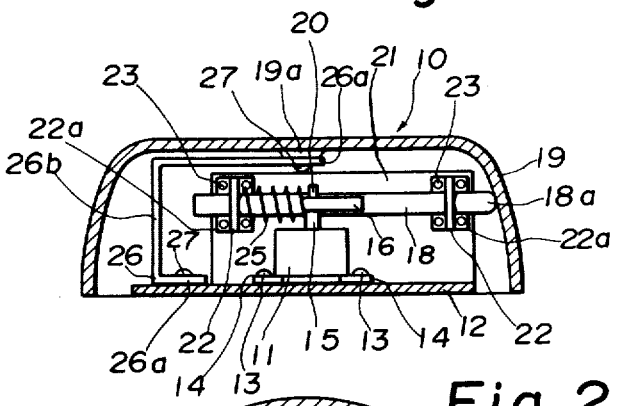
FIG. 1 is a cross-sectional view of a motor actuated bell provided in accordance with this invention.
Figure 2:
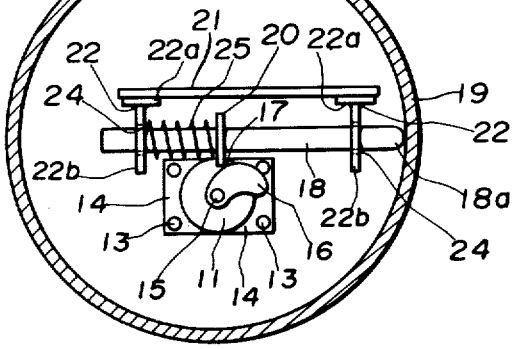
FIG. 2 is a schematic plan view of the bell with a gong broken away.
Figure 3:
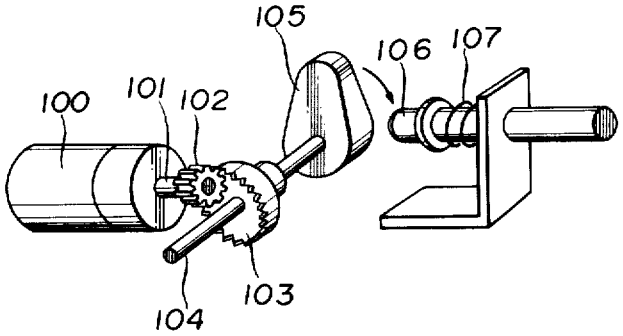
Fig. 3 (Prior Art)
FIG. 3 is a schematic perspective view of a motor actuated bell constructed in accordance with the prior art.

FIGS. 1 and 2 show a motor actuated bell 10 in accordance with the invention. An electric motor 11 is mounted on and secured to a mounting plate 12 by screws 13 passing through a pair of flanges 14, 14 into the mounting plate, the motor having a drive shaft 15 disposed perpendicular to the plane of the mounting plate 12.

A cam member or plate 16 is fixedly mounted on the motor drive shaft 15 at its one end for rotation therewith about the drive shaft, the cam member being disposed in parallel spaced relationship to the mounting plate 12. The cam member 16 has an arcuate surface or edge 17 capable of serving as a cam surface.

An elongated hammer member 18 of a cylindrical shape is rounded at its one end **18*a* to provide a hammer head for striking against the inner peripheral wall of a gong 19. A collar or ring 20 is fixedly mounted on the hammer member 18** intermediate the opposite ends thereof.

A stamped-out portion 21 of the mounting plate 12 extends perpendicular to the plane of the mounting plate, the mounting portion 21 being disposed in spaced relationship to the motor 11.

A pair of spaced brackets 22, 22 of a T-shaped cross-section having a base **22*a* and a leg 22*b* extending from the base are fixedly secured to one surface of the mounting portion facing the motor 11 by screws 23 passing through their respective bases 22*a* into the upper portion of the mounting portion 21. Each of the brackets 22, 22 has an opening 24, 24** formed through the leg portion.

The hammer member 18 is supported by the brackets 22, 22 for sliding movement along its axis in parellel spaced relationship to the mounting plate 12, the hammer member 18 being slidably received in the opeinings 24, 24 of the brackets 22, 22 adjacent to its opposite ends.

The cam member 16 and the hammer 18 are spaced generally equidistantly from the plane of the mounting plate 12 so that the cam surface 17 is engageable with the collar 20 fitted on the hammer member 18.

A coil spring 25 acts between the left-hand bracket 22 and the collar 20 to normally urge the hammer head **18*a* into contact with the inner wall of the gong 19, the coil spring being wound around the hammer member 18**.

The mounting plate 12 is arranged within the gong 19 of an inverted cup-shape. A connecting member 26 of a generally channel-shaped cross-section has a pair of arms **26*a*, 26*a* and a base 26*b* interconnecting the arms. The connecting member 26 interconnects the mounting plate 12 and the gong 19 by screws 27 passing respectively through the upper arm 26*a* into a boss 19*a* of the gong and through the lower arm 26*a* into the mounting plate 12**.

In operation, the motor 11 is first driven by a power source (not shown) to rotate the cam member 16 in a counterclockwise direction to allow the cam surface 17 to engage the collar 20 so that the hammer member 18 is urged away from the inner wall of the gong 19 against the bias of the coil spring 25, with the hammer head **18*a* spaced away from the gong wall. The cam member 16 continues to rotate counterclockwise and is brought out of engagement with the collar 20 whereupon the hammer 18 snaps back under the action of the coil spring 25 to bring the hammer head 18*a* into striking contact with the inner wall of the gong 19** with substantial impact to produce bell sound of the required volume. This cycle of operation is continuously repeated.

As described above, the coil spring imparts sufficient momentum to the hammer to allow the same to strike against the gong with substantial impact so that the bell sound of great volume can be produced.

While the motor actuated bell according to this invention have been specifically shown and described herein, the invention itself is not to be restricted by the exact showing of the drawings or the description thereof. For example, the hammer may be normally disposed out of contact with the gong when the hammer is in its inoperative position. Further, a speed reducer may be connected to the motor drive shaft to actuate the hammer at a lower speed.

What is claimed is:

1. A motor actuated bell which comprises:

(a) a base;

(b) a gong mounted on said base, (c) a motor mounted on said base and having a rotatable drive shaft;

(d) a bracket mounted on said base, (e) an elongated hammer member having one end slidably extending through said bracket for movement along the axis of said hammer member and having a second end for striking against said gong;

(f) an engaging means disposed on said elongated hammer member intermediate the opposite ends thereof, (g) a contractible coil spring wound around said elongated hammer member and acting between said bracket and said engaging means for normally urging said hammer member toward said gong; and (h) a cam means connected to the motor drive shaft, said cam means being engageable with said engaging means for moving said hammer member away from said gong against the bias of said coil spring and disengageable with said engaging means for bringing said hammer member into striking contact with said gong under the action of said coil spring.

2. The motor actuated bell according to claim 1 wherein said engaging means comprises a collar fixedly mounted on said hammer member.

3. The motor actuated bell according to claim 1 wherein said cam means is fixedly mounted on the motor drive shaft for rotation therewith, said cam means having an arcuate cam surface engageable with said engaging means.

4. A motor actuated bell which comprises:

(a) a base;

(b) a gong mounted on said base;

(c) a motor having a rotatable drive shaft mounted on said base;

(d) a bracket formed with a channel and being mounted on said base;

(e) an elongated hammer slidably extending through said channel formed in said bracket for reciprocal movement along its length;

(f) a collar disposed on said elongated hammer intermediate the ends thereof;

(g) a coil spring wound around said hammer and acting between said collar and said channel; and (h) a cam connected to the motor drive shaft, said cam having an arcuate surface being alternatingly engageable with said collar for moving said hammer away from said gong and compressing said coil spring, and said cam surface being alternatingly disengageable with said collar for urging said hammer into striking contact with said gong under the releasing action of said compressed coil spring.

* * * * *